US008238800B2

(12) United States Patent
Hatano

(10) Patent No.: US 8,238,800 B2
(45) Date of Patent: Aug. 7, 2012

(54) DEVELOPING APPARATUS

(75) Inventor: Fukashi Hatano, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 279 days.

(21) Appl. No.: 12/234,102

(22) Filed: Sep. 19, 2008

(65) Prior Publication Data

US 2009/0087230 A1 Apr. 2, 2009

(30) Foreign Application Priority Data

Sep. 28, 2007 (JP) ..... 2007-253127

(51) Int. Cl.
*G03G 15/08* (2006.01)

(52) U.S. Cl. ..... 399/265; 399/107; 399/110; 399/111; 399/119; 399/120; 399/252; 399/258; 399/262; 399/263

(58) Field of Classification Search ..... 399/265, 399/107, 110, 111, 119, 120, 252, 258, 262, 399/263

See application file for complete search history.

(56) References Cited

U.S. PATENT DOCUMENTS

| | | | | |
|---|---|---|---|---|
| 3,985,438 | A * | 10/1976 | Kurita | 399/217 |
| 5,528,343 | A * | 6/1996 | Tada et al. | 399/113 |
| 6,839,535 | B2 | 1/2005 | Sugiyama | |
| 2002/0054773 | A1 * | 5/2002 | Shirai | 399/269 |

FOREIGN PATENT DOCUMENTS

| | | | |
|---|---|---|---|
| JP | 3-168665 | A | 7/1991 |
| JP | 6-89060 | A | 3/1994 |
| JP | 2002-357951 | A | 12/2002 |
| JP | 2003-307930 | A | 10/2003 |

OTHER PUBLICATIONS

Notification of the Second Office Action dated Dec. 7, 2011, in Chinese Application No. 200810168109.0.

* cited by examiner

*Primary Examiner* — David Porta
*Assistant Examiner* — Shun Lee
(74) *Attorney, Agent, or Firm* — Fitzpatrick, Cella, Harper & Scinto

(57) ABSTRACT

A developing apparatus for developing a latent image formed on an image bearing member with a developer includes a first developer carrying member for carrying and feeding the developer by rotation thereof about a rotation axis which is at a fixed position; a second developer carrying member for carrying and feeding the developer by rotation thereof, the second developer carrying member having a rotation axis which is swingable relative to the first developer carrying member; a supporting member for supporting the second developer carrying member swingably about the first developer carrying member; a driving device for applying a driving force to the first developer carrying member; and a driving belt for transmitting the driving force applied to the first developer carrying member to the second developer carrying member.

9 Claims, 8 Drawing Sheets

DEVELOPING APPARATUS

FIELD OF THE INVENTION AND RELATED ART

The present invention relates to a developing apparatus which uses developer to develop a latent image formed on an image bearing member. In particular, it relates to a developing apparatus which uses developer to develop a latent image formed on an image bearing member and is employed by an image forming apparatus, such as a copying machine, a printer, a facsimile machine, etc., which forms an image with the use of an electrophotographic image forming method.

The image forming operation of an image forming apparatus, such as a copying machine, a laser beam printer, a facsimile machine, a commercial printing apparatus, etc., which uses an electrophotographic image forming method, is as follows: First, a portion of the peripheral surface of the image bearing member of the image forming apparatus is uniformly charged, and then, the uniformly charged portion of the peripheral surface is exposed with a semiconductor laser, an LED, or the like, to form an electrostatic latent image across the uniformed charged portion.

Thereafter, the electrostatic latent image is developed by a developing apparatus, into a visible image, that is, an image formed of developer. Then, the visible image is transferred onto a transfer medium, and is fixed to the transfer medium by a fixing apparatus. Then, the transfer medium bearing the fixed visible image is discharged from the image forming apparatus.

In recent years, not only have computers come to be widely used, but also, they have come to be widely networked. Thus, an image forming apparatus which is capable of outputting the information which it receives through a computer network has come to be widely used. Consequently, the demand for an image forming apparatus which is significantly faster and higher in image quality than with a conventional image forming apparatus has become stronger.

As one of the developing apparatuses employed by a high speed image forming, such as the above-described one, there is a developing apparatus which is provided with two or more developer bearing members (Japanese Laid-open Patent Application H03-168665, for example). Some image forming apparatuses are structured so that their photosensitive drum and development sleeve are positioned to maintain a minute amount of gap (SD gap) between the photosensitive drum and development sleeve in order to satisfactorily develop a latent image on the photosensitive drum.

That is, in order to ensure that the SD gap remains stable, each of the lengthwise end portions of the development sleeve is provided with a separating member for keeping the development sleeve separated from the photosensitive drum. More specifically, each of the lengthwise end portions of the development sleeve is provided with a spacer roller, the peripheral surface of which is to remain in contact with the peripheral surface of the photosensitive drum, or a space roller seat, with which the developing apparatus frame is provided.

Thus, in the case of a developing apparatus having two or more development sleeves, four or more spacer rollers are to be kept in contact with the peripheral surface of the photosensitive drum in order to maintain a proper amount of SD gap between each development sleeve and the photosensitive drum. Thus, it is possible for some of the spacer rollers to fail to remain in contact with the peripheral surface of the photosensitive drum. For example, it is possible that three spacer rollers will remain in contact with the peripheral surface of the photosensitive drum, whereas the fourth one will fail.

As one of the solutions to the above-described problem, it is possible to increase the pressure applied to the development apparatus frame to keep the developing apparatus pressured toward the photosensitive drum in order to ensure that all the spacer rollers (four spacer rollers, for example) are placed and remain in contact with the photosensitive drum. However, it is possible that increasing the amount of the pressure applied to the developing apparatus frame will deform the developing apparatus frame, generating stress in the developing apparatus frame, which creates the problem that as the development sleeves and photosensitive drum rotate, the frame vibrates, resulting in the formation of a substandard image. In addition, the keeping of the developing apparatus frame under stress may result in the destruction of the developing apparatus frame.

As one of the solutions to the above-described secondary problem, the following structural arrangement has been proposed: Adjacent two development sleeves (first and second, for example) are rotatably supported with the provision of a preset amount of gap between them, and further, the second development sleeve is supported in a manner to allow the secondary development sleeve to rotationally move about the rotational axis of the first development sleeve in an oscillatory manner (Japanese Laid-open Patent Application 2000-357951, for example). This structural arrangement can prevent the spacer rollers from floating from the peripheral surface of the photosensitive drum. That is, it can prevent the problem that the developing apparatus becomes unstable in the amount of the SD gap.

However, a developing apparatus structured so that the second development sleeve is made rotationally movable in an oscillatory manner about the axial line of the first development sleeve as disclosed in Japanese Laid-open Patent Application 2002-357951 suffers from the following problem: For example, in the case of a developing apparatus structured so that its multiple development sleeves are driven by a single mechanical power source, the driving force has to be transmitted from the power source to the first development sleeve, for example, and then, to the next development sleeve. Thus, if a gear or gear train is used to transfer the driving force from the first development sleeve to the second development sleeve, the second development sleeve is pushed by the driving force (torque) from the first development sleeve, in the direction in which the second development sleeve is rotationally movable in an oscillatory manner, as the driving force (torque) is transmitted from the first development sleeve to the second development sleeve. Therefore, it is difficult to keep the SD gap stable.

In the case of a developing apparatus structured as shown in FIGS. 7 and 8, the force for driving the first development sleeve 110 is transmitted from the development sleeve driving gear (not shown) to the development sleeve driving force input gear 118, whereas the force for driving the second development sleeve 111 is transmitted from the first development sleeve gear 119 to the second development sleeve gear 120 through an idler gear 122.

The idler gear 122 is supported by a pivotally movable member 113, by which the shaft of the first development sleeve 110 and the shaft of the second development sleeve 111 are connected to each other. That is, the idler gear 122 and second development sleeve gear 120 are supported so that the distance between the shaft by which the idler gear 122 is supported, and the shaft by which the second development sleeve gear 120 does not change. Therefore, the force and reactive forces which occur between the two gears 122 and 120 cancel each other. Therefore, the second development sleeve 111 is not affected by the force and reactive forces which occur between the two gears 122 and 120.

In this case, as driving force is transmitted to the first development sleeve 110, the idler gear 122 and second development sleeve 111 are subjected to force, such as the one shown in the drawings. The greater the amount of torque necessary to rotate the second development sleeve 111, the amount of the force shown in the drawings, and therefore, the smaller the amount of the force which the spacer rollers 117 of the second development sleeve 111 is subjected.

Thus, it is possible to provide the developing apparatus with a spring or the like to keep the pivotally movable member pressed toward the photosensitive drum so that the problem that the force placed on the spacer rollers 117 of the second development sleeve 111 is reduced by the driving of the second development sleeve 111 can be prevented by adjusting the spring or the like in the force it generates. However, this solution is problematic in that as the amount of torque to which the gears are subjected changes due to usage, the amount by which the spacer rollers 117 are kept pressed upon the drum also changes. In the worst case, the increase in the amount of the torque causes the spacer rollers 117 of the second development sleeve 111 to float from the peripheral surface of the photosensitive drum. Further, if the torque is unstable in the amount, the second development sleeve 111 vibrates, and therefore, there is no guarantee that the SD gap remains stable.

FIG. 9 shows the amount and direction of the force which is generated between the idler gear 122 and first development sleeve gear 119 as the force for driving the second development sleeve 111 is transmitted to the second development sleeve 120. Three circles in the drawing, which are designated by referential codes Φ28, Φ20, and Φ20, represent the first development sleeve gear 119, second development sleeve gear 120, and idler gear 122.

It is assumed here that the amount of torque necessary to rotate the second development sleeve 111 is 1 kgf·cm. As the first development sleeve 110 rotates, the second development sleeve 111 is rotated by the rotation of the first development sleeve 110 through the first development sleeve gear 119, idler gear 122, and second development sleeve gear 120.

The developing apparatus is structured so that the idler gear 122 and second development sleeve gear 120 are supported by the pivotally movable holder 113 so that they can be rotationally moved about the axial line of the first development sleeve 110.

Therefore, as the first development sleeve 110 is rotated, force is generated between the second development sleeve gear 119 and idler gear 122 in the direction to rotationally move the second development sleeve 111 about the axial line of the first development sleeve 110. The direction and amount of this force are as shown in FIG. 9; the direction is shown by a thick arrow mark, and the force is 1 kgf. Further, the idler gear 122 and second development sleeve gear 120, which are surrounded by a broken line in the drawing are subjected together to this force, which acts in the direction to move them away from the photosensitive drum 101.

If the idler gear 122 is fixed in position as shown in FIGS. 10 and 11, the torque transmitted from the idler gear 122 to the second development sleeve gear 120 works in the direction to move the second development sleeve gear 120, and therefore, the spacer rollers 117, toward the photosensitive drum. However, the idler gear 122 and second development sleeve gear 120 are supported so that the distance between the shaft by which the idler gear 122 is supported, and the shaft by which the second development sleeve gear 120 is supported, does not change. Therefore, the force and reactive forces which occur between the two gears 122 and 120 cancel each other. Therefore, the second development sleeve 111 is not affected by the force and reactive forces which occur between the two gears 122 and 120.

Unlike the setup shown in FIG. 8, in this case, as the torque increases, the pressure to which the spacer rollers 117 are subjected increases, and the increase in the pressure deforms the spacer rollers 117, making the developing apparatus unstable in the amount of the SC gap. Further, the increase in the amount of the torque reduces the amount of the pressure applied to the spacer rollers 117 of the first development sleeve 110, making it possible for the spacer rollers 117 to float from the peripheral surface of the photosensitive drum 101.

SUMMARY OF THE INVENTION

The present invention was made in consideration of the above-described technical problems. Thus, the primary object of the present invention is to provide a developing apparatus, the second developer bearing member of which is supported so that it can be moved in an oscillatory manner relative to the first developer bearing member to highly precisely maintain a preset amount of gap between each of the developer bearing members and the image bearing member, and which yet does not change in the amount of the force which is generated in the direction to move the second developer bearing member in the oscillatory manner, by the torque transmitted from the first development bearing member to the second developer bearing member.

According to an aspect of the present invention, there is provided a developing apparatus for developing a latent image formed on an image bearing member with a developer, said apparatus comprising a first developer carrying member for carrying and feeding the developer by rotation thereof about a rotation axis which is at a fixed position; a second developer carrying member for carrying and feeding the developer by rotation thereof, said second developer carrying member having a rotation axis which is swingable relative to said first developer carrying member; a supporting member for supporting said second developer carrying member swingably about said first developer carrying member; a driving device for applying a driving force to said first developer carrying member; and a driving belt for transmitting the driving force applied to said first developer carrying member to said second developer carrying member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 1:
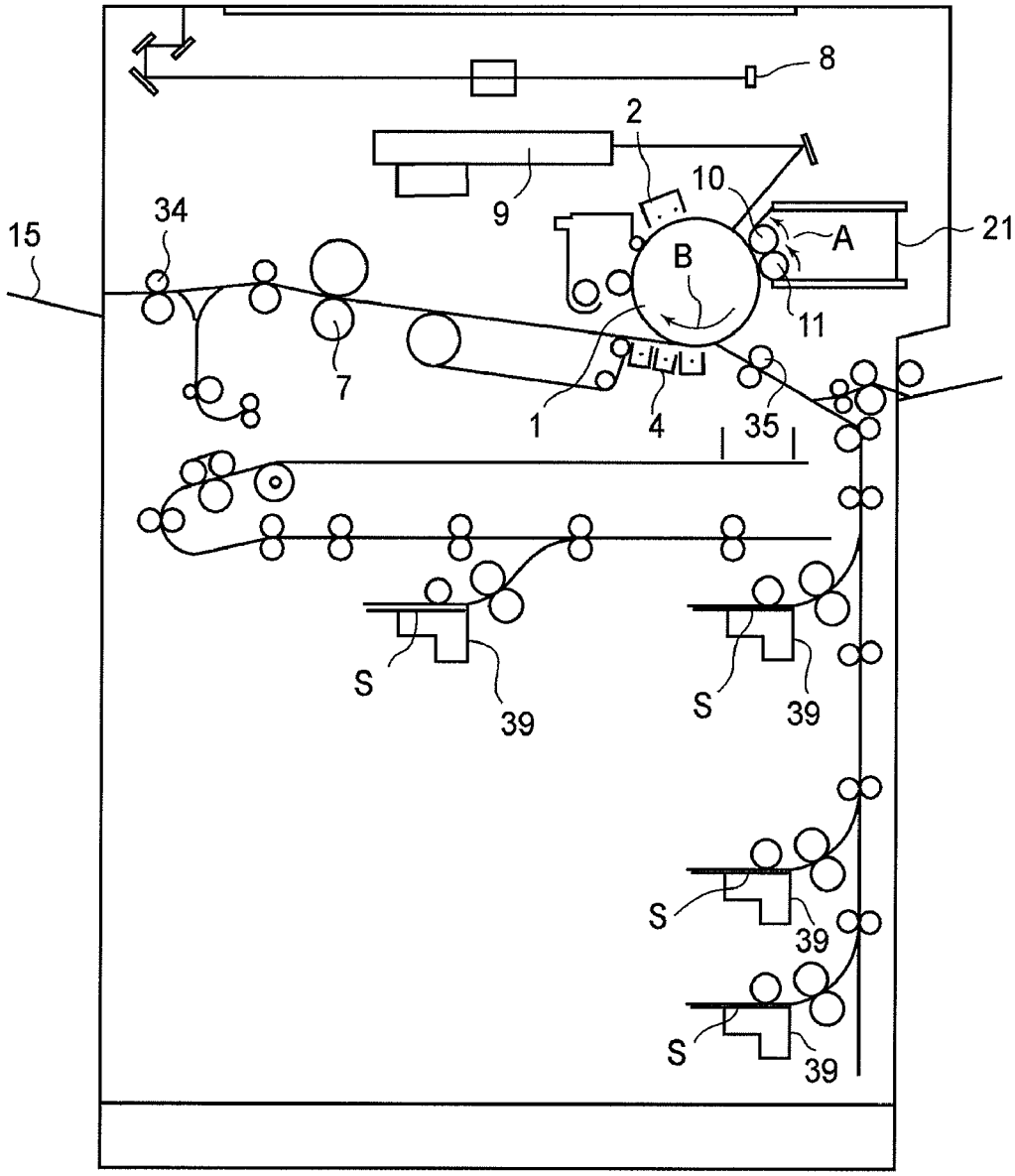
FIG. 1 is a schematic drawing of the image forming apparatus in the first embodiment of the present invention, showing the general structure of the apparatus.
Figure 2:
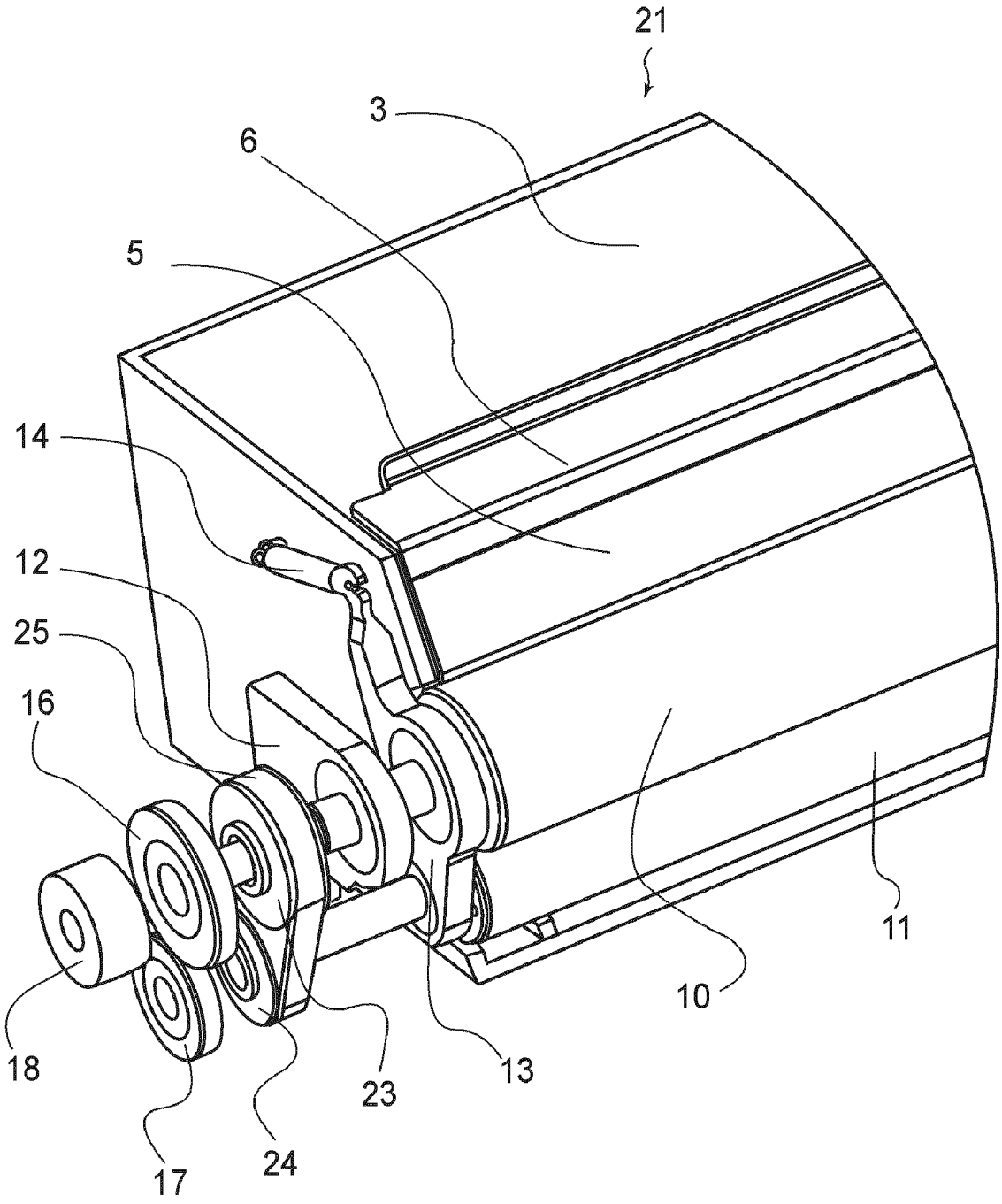
FIG. 2 is a perspective view of the portions of the developing apparatus shown in FIG. 1.

Hereinafter, the preferred embodiments of the present invention will be described in detail with reference to the appended drawings. FIG. 1 is a schematic drawing of the image forming apparatus in the first embodiment of the present invention, and shows the general structure of the apparatus. FIG. 2 is a perspective view of the essential portions of the developing apparatus shown in FIG. 1.

The image forming apparatus shown in FIG. 1 reads the image data of an original, with the use of an image reading portion 8, which makes up the top portion of the image forming apparatus. The image forming apparatus is provided with an image writing portion 9, which is below the image reading portion 8. The image forming apparatus is also provided with a photosensitive drum 1 as a latent image bearing member. The image writing portion 9 forms an electrophotographic latent image on the photosensitive drum 1 by exposing the peripheral surface of the photosensitive drum 1, based on the image data read by the image reading portion 8, in response to a command from a controller (not shown).

More specifically, a part of the peripheral surface of the photosensitive drum 1 is uniformly charged to a preset potential level by a charging device 2, and then, is exposed to a beam of light, such as a beam of laser light, projected from the image writing portion 9. As a result, an electrostatic latent image is effected on the uniformly charged part of the peripheral surface of the photosensitive drum 1.

Then, toner, which is developer, is adhered to the electrostatic latent image on the peripheral surface of the photosensitive drum 1 by a developing apparatus 21 to develop the electrostatic latent image into a visible image. As a result, a visible image is formed of toner on the peripheral surface of the photosensitive drum 1. Then, the visible image (which hereafter will be referred to as toner image) is conveyed to a transferring apparatus 4 by the rotation of the photosensitive drum 1.

Meanwhile, a sheet S, which is a sheet of recording medium, is conveyed one by one into the main assembly of the image forming apparatus from a sheet cassette 39 in synchronism with the conveyance of the toner image to the transferring apparatus 4. Then, the sheet S is conveyed to the interface between the peripheral surface of the photosensitive drum 1 and the transferring member of the transferring apparatus 4 by a pair of registration rollers 35 while being controlled in the timing with which it arrives at the interface.

While the sheet S is conveyed between the photosensitive drum 1 and transferring apparatus 4, the toner image, that is, the developed latent image, on the photosensitive drum 1 is transferred onto the sheet S by the transferring apparatus 4.

After the transfer of the toner image onto the sheet S, the sheet S is conveyed to a pair of fixation rollers 7, being subjected to the pressure generated by the pair of fixation rollers 7, and the heat generated by the heaters (not shown) in the fixation rollers 7, one for one. As a result, the toner image is welded (fixed to the sheet S). Then, the sheet S is discharged by a pair of discharge roller 34 into a tray 15, which is outside the main assembly of the image forming apparatus.

The developing apparatus 21 is provided with a first development sleeve 10 (first developer bearing member) and a second development sleeve 11 (second developer bearing member), which are cylindrical and are rotatable. The first and second development sleeves 10 and 11 are positioned so that their peripheral surfaces face the peripheral surface of the photosensitive drum 1, and also, so that a preset amount of gap (SD gap) is maintained between the peripheral surface of each of the two development sleeves and the peripheral surface of the photosensitive drum 1. The developer in the developing apparatus 21 is borne on the peripheral surface of the first and second development sleeves 10 and 11, in a thin uniform layer.

The first and second sleeves 10 and 11 are rotated in the direction indicated by an arrow mark A, while bearing and conveying developer to the area (development area) where the peripheral surface of the photosensitive drum 1 opposes the peripheral surface of each of the development sleeves 10 and 11. The photosensitive drum 1 is rotated in the direction indicated by an arrow mark B, conveying the electrostatic latent image formed thereon to the development area where the peripheral surface of the development sleeve 10 opposes the peripheral surface of the photosensitive drum 1, and the development area where the peripheral surface of the second development sleeve 11 opposes the peripheral surface of the photosensitive drum 1.

The electrostatic latent image formed on the peripheral surface of the photosensitive drum 1 is first developed in the development area, which corresponds to the first development sleeve 10. Then, it is developed in the development area, which corresponds to the second development sleeve 11. In terms of the flow of the development process, the first development sleeve 10 is on the upstream side of the second development sleeve 11. Incidentally, the development process carried out in each of the two development areas is the process for developing an electrostatic latent image with the use of one of the known technologies for developing an electrostatic latent image.

The developer used by the image forming apparatus in this embodiment is a nonmagnetic single-component toner. There is a magnetic field generating member, for example, a stationary magnetic roller (not shown), in each of the development sleeves 10 and 11. The developer (toner) in the developer containing portion of the developing apparatus frame is supplied to the development sleeves 10 and 11 by the magnetic field generating means located in the development sleeves 10 and 11, one for one.

The toner borne on the peripheral surface of each of the development sleeves 10 and 11 in thin and uniform layer with a preset thickness, transfers onto the numerous points on the peripheral surface of the photosensitive drum 1, the negative charge of which has reduced due to the above-mentioned exposure, developing in reverse the electrostatic latent image on the peripheral surface of the photosensitive drum 1. Normally, a development bias, which is a combination of AC voltage and DC voltage, for example, is applied to the development sleeves 10 and 11 during a development period.

The present invention relates to the structure of a mechanism for driving a developer bearing member. That is, the developing method described above is not intended to limit the present invention in terms of development method. In other words, the present invention is compatible with any known developing method for developing an electrostatic latent image with the use of a developing apparatus having two or more development sleeves.

For example, the present invention is also compatible with a developing method which uses two-component developer, more specifically, a combination of magnetic carrier and non-magnetic toner. Two-component developer is borne by a developer bearing member, which contains a magnetic field generating means, so that the two component developer is made to crest (in the form of a brush, that is, a magnetic brush). Thus, an electrostatic latent image formed on the peripheral surface of an image bearing member can be developed by placing the magnetic brush actually or virtually in contact with the peripheral surface of the image bearing member.

In the case of the developing apparatus in this embodiment, an electrostatic latent image is developed twice, that is, developed by two development sleeves. Thus, the developing apparatus in this embodiment is greater in the size of the development area than a developing apparatus having only one development sleeve. Therefore, the developing apparatus in this embodiment can prevent the above-described problems, that is, the problems attributable to the increase in the process speed (copying speed) of an image forming apparatus.

To describe more concretely, as a developing apparatus is increased in the peripheral speed of its development sleeve to deal with the demand for a developing apparatus with a faster process speed, the development sleeve becomes higher in temperature than the development sleeve of a developing apparatus of the normal speed. If the temperature of a development sleeve exceeds a certain level, developer is liable to become welded to the development sleeve. If developer becomes welded to a development sleeve, the amount of torque necessary to rotate the development sleeve increases and/or the developer welded to the development sleeve is liable to interfere with the rotation of the development sleeve. These problems can be prevented by employing a developing apparatus having two or more development sleeves. Further, providing a developing apparatus with two or more development sleeves makes it possible to prevent the problem that increased friction against developer causes the developer to deteriorate, which results in the formation of a substandard image.

Next, referring to FIG. 2, the developing apparatus 21 will be described. The first development sleeve 10 is the first developer bearing member. It contains a magnet. It is rotatably borne by a bearing held by a bearing holder 12, which is fixed to a developer container portion of the developing apparatus frame 3, in which developer is stored. That is, the shaft of the first development sleeve 10 is fixed in position so that the position of the rotational axis of the first development sleeve 10 does not change relative to the photosensitive drum 1. The second development sleeve 11 is the second developer bearing member. It is rotatably supported by a pivotally movable connective holder 13, which is pivotally supported by the shaft of the first development sleeve 10. In terms of the rotational direction of the image bearing member (moving direction of peripheral surface of photosensitive drum), the first development sleeve 10 is on the upstream side of the second development sleeve 11. The first development sleeve 10 rotates in the opposite direction from the rotational direction of the photosensitive drum 1.

Thus, the second development sleeve 11 can be rotationally moved relative to the first development sleeve 10 in such a manner that the axial line of the second development sleeve 11 is rotationally moved about the axial line of the second development sleeve 11. Thus, the second development sleeve 11 can also be moved relative to the photosensitive drum 1. The pivotally movable connective holder 13 is kept pressed by a second spring 14 so that it will pivot toward the photosensitive drum 1.

The developer container portion of the developing apparatus housing 3 is provided with a stopper (not shown), so that the angle, by which the pivotally movable connective holder 13 is movable, falls within a preset range. The second development sleeve 11 can be rationally moved to a point which it is closer to the photosensitive drum 1 than a preset point.

The developing apparatus 21 is provided with a blade holding member 6 and a developer regulating blade 5. The blade holding member 6 is located above the first development sleeve 10, and is fixed to the developing apparatus frame 3. The developer regulating blade 5 is held by the blade holding member 6. The gap (first SD gap) between the first development sleeve 10 and photosensitive drum 1, gap (second SD gap) between the second development sleeve 11 and photosensitive drum 1, and gap (SS gap) between the first development sleeve 10 and second development sleeve 11 have to be highly precisely maintained.

Thus, the developing apparatus 21 is provided with a pair of spacer rollers 16, which remain in contact with the peripheral surface of the photosensitive drum 1 to ensure that a preset amount of gap is maintained between the first development sleeve 10 and photosensitive drum 1. The spacer rollers 16 are located at the lengthwise ends of the shaft of the first development sleeve 10, one for one, being coaxial with the first development sleeve 10.

Further, the developing apparatus 21 is provided with a pair of spacer rollers 17, which remain in contact with the peripheral surface of the photosensitive drum 1 to ensure that a preset amount of gap is maintained between the second development sleeve 11 and photosensitive drum 1. The spacer rollers 17 are located at the lengthwise ends of the shaft of the second development sleeve 11, one for one, being coaxial with the second development sleeve 11. The amount of the SS gap is fixed by the distance between the axial line of the bearing hole of the pivotally movable connective holder 13, which corresponds to the first development sleeve 10, and the axial line of the bearing hole of the pivotally movable connective holder 13, which corresponds to the second development sleeve 11. That is, the accuracy of the amount of the SS gap is set by the accuracy with which the above-described components of the developing apparatus 21 are manufactured and assembled.

A rotational driving force input gear 18 receives driving force from an input gear 32 with which the main assembly of the image forming apparatus is provided. Then, it transmits the driving force to the first development sleeve 10. The input gear 32 is attached to the drive shaft 31 of a motor 30, for example, which is a driving apparatus. Thus, it is through the input gear 32 that the driving force from the motor 30 is transmitted to the rotational driving force input gear 18.

Further, the developing apparatus 21 is provided with a pulley 23, a pulley 24, and a timing belt 25. The pulleys 23 and 24 are fitted around the shaft of the first development sleeve 10 and the shaft of the second development sleeve 11, respectively. The timing belt 25 also functions as a development sleeve driving belt, and is stretched around the pulleys 23 and 24 to transmit the driving force from the first development sleeve 10 to the second development sleeve 11. In consideration of the rotational speed of the pulleys 23 and 24, the pulleys 23 and 24 are given 45 and 34 teeth, respectively.

Figure 3:
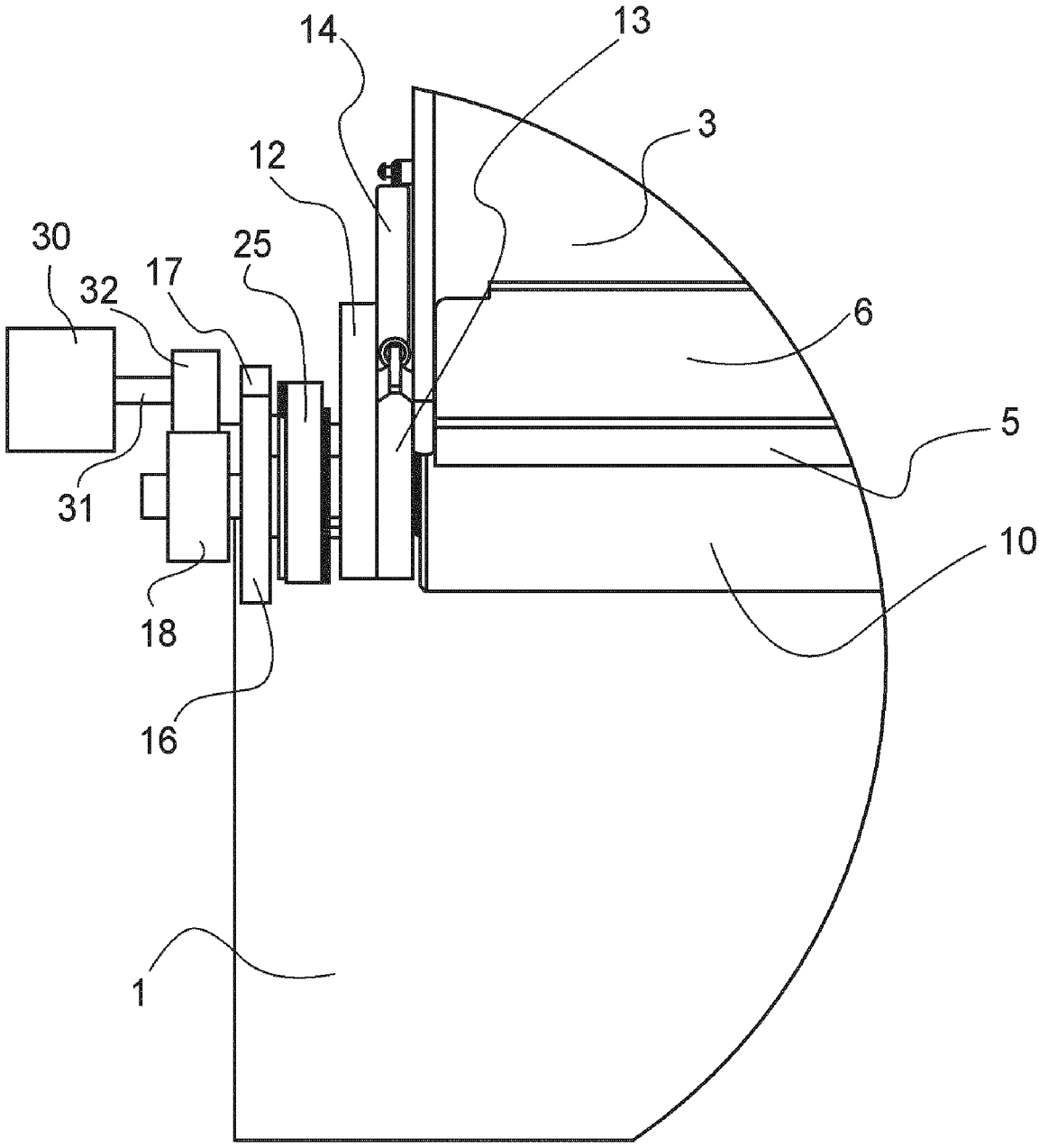
FIG. 3 is a front view of the portions of the developing apparatus, which are shown in FIG. 2.

FIG. 3 is a front view of the essential portions of the developing apparatus 21. Placing the spacer rollers 16 and 17 in contact with the peripheral surface of the photosensitive drum 1 ensures that the SD gap corresponding to the spacer rollers 16, and the SD gap corresponding to the spacer rollers 17, remain stable. In order to prevent the timing belt 25 from coming in contact with the photosensitive drum 1 while transmitting the driving force, the spacer rollers 16 and 17 are made greater in diameter than the pulleys 23 and 24.

Figure 4:
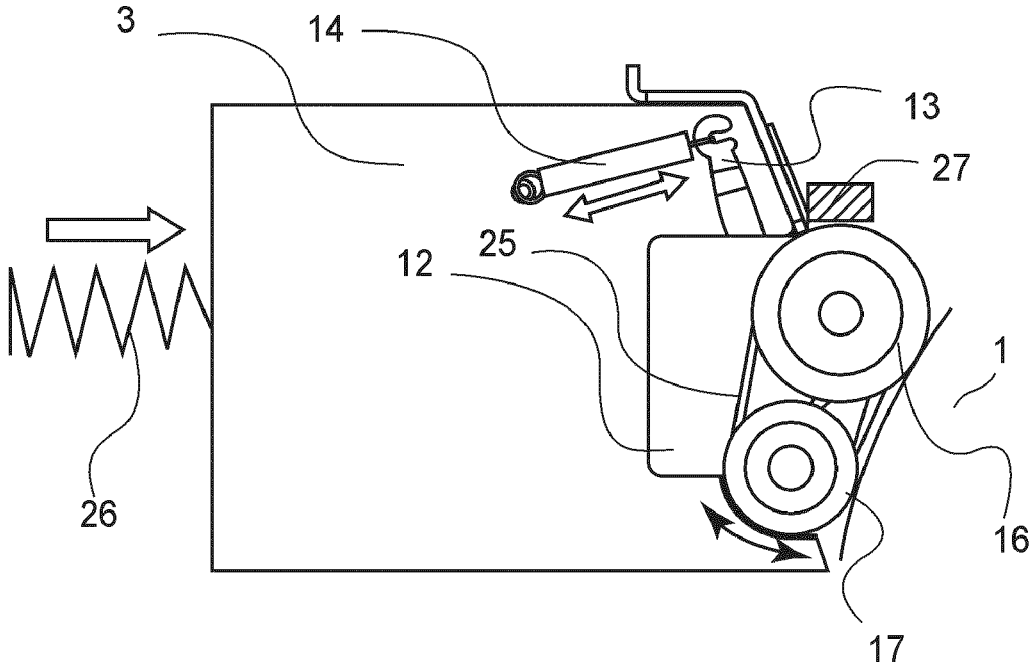
FIG. 4 is a side view of the portions of the developing apparatus, which are shown in FIG. 2.

Referring to FIG. 4, as the developing apparatus 21 is mounted into the apparatus main assembly, the housing 3 of the developing apparatus 21 is pressed toward the photosensitive drum 1 by the first springs 26. As the housing 3 is pressed toward the photosensitive drum 1, first, the spacer rollers 17 of the second development sleeve 11 come into contact with the photosensitive drum 1, and then, is moved to a preset position by being rotationally moved about the rotational axis of the first development sleeve 10.

Then, the spacer rollers 16 of the first development sleeve 10 come into contact with the photosensitive drum 1. The vertical position of the developing apparatus 21 is fixed by the contact between a pair of positioning members 27 and corresponding spacer rollers 16, one for one. The amount of the first SD gap and amount of the second SD gap are determined by the contact between the spacer rollers 17 and photosensitive drum 1 and the contact between the spacer rollers 16 and photosensitive drum 1.

In consideration of the possibility that the spacer rollers 16 and 17 will be deformed, the amount of the pressure applied to the spacer rollers 16 and 17 per roller is set to a value in a range of 1-2 kg. If the pressure applied to the spacer rollers 16 and 17 is increased beyond a certain value, the spacer rollers 16 and 17 are deformed, reducing the SD gap.

On the other hand, it is possible that if the pressure applied to the spacer rollers 16 and 17 is smaller than a certain value, the contact between the spacer rollers 16 and photosensitive drum 1, and the contact between the spacer rollers 17 and photosensitive drum 1, become unstable, allowing the spacer rollers 16 and 17 to float from the peripheral surface of the photosensitive drum 1. Thus, the pressure applied to the spacer rollers 16 and 17 is desired to be as small as possible in the amount of fluctuation.

Next, the operation of the developing apparatus 21 will be described.

Figure 5:
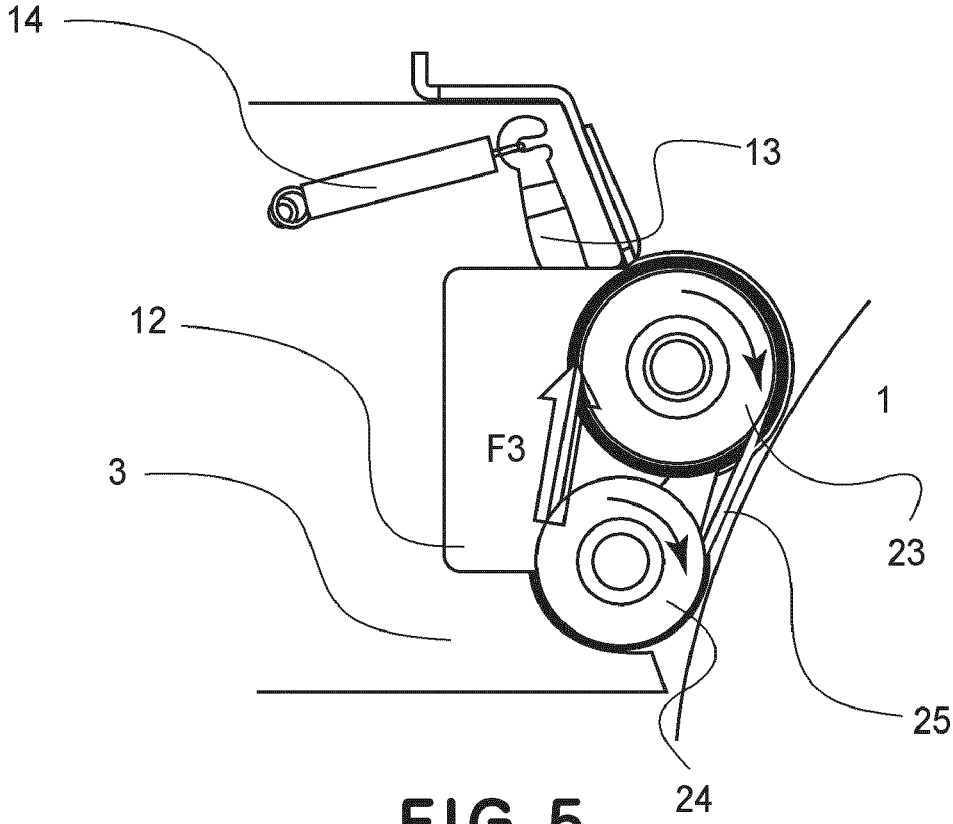
FIG. 5 is a schematic drawing of the developing apparatus shown in FIG. 4, which is being driven.

Referring to FIG. 5, as the first development sleeve 10 rotates, the second development sleeve 11 is rotated in the direction indicated in the drawing, by the rotation of the first development sleeve 10 through the pulley 23, timing belt 25, and pulley 24. As the second development sleeve 11 is rotated by the rotation of the first development sleeve 10, the second development sleeve 11 is subjected to the force generated by the timing belt 25 in the direction indicated by the thick arrow mark in the drawing. This force acts in the direction to press the second development sleeve 11 away from the photosensitive drum 1.

Figure 6:
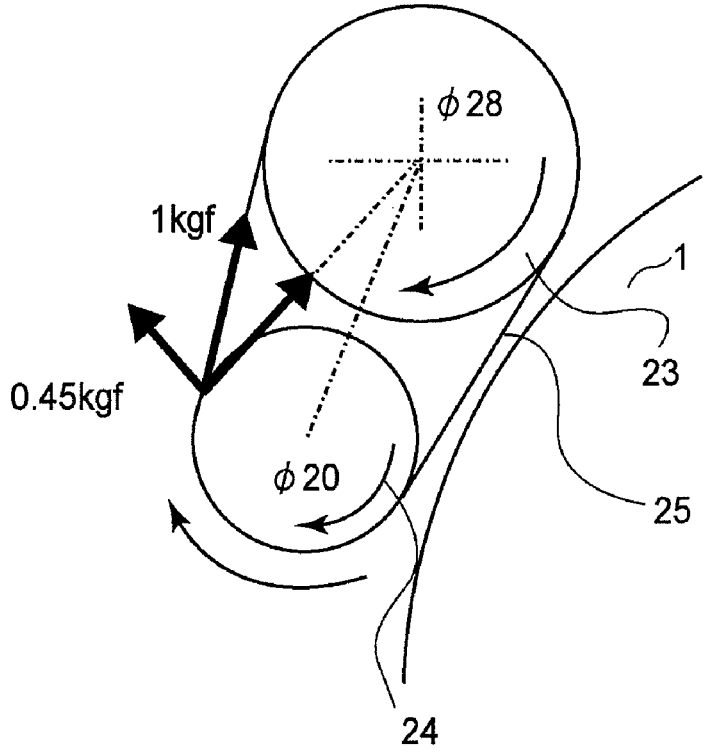
FIG. 6 is a schematic drawing for describing the forces which are generated as the developing apparatus structured as shown in FIG. 5 is driven.
Figure 7:
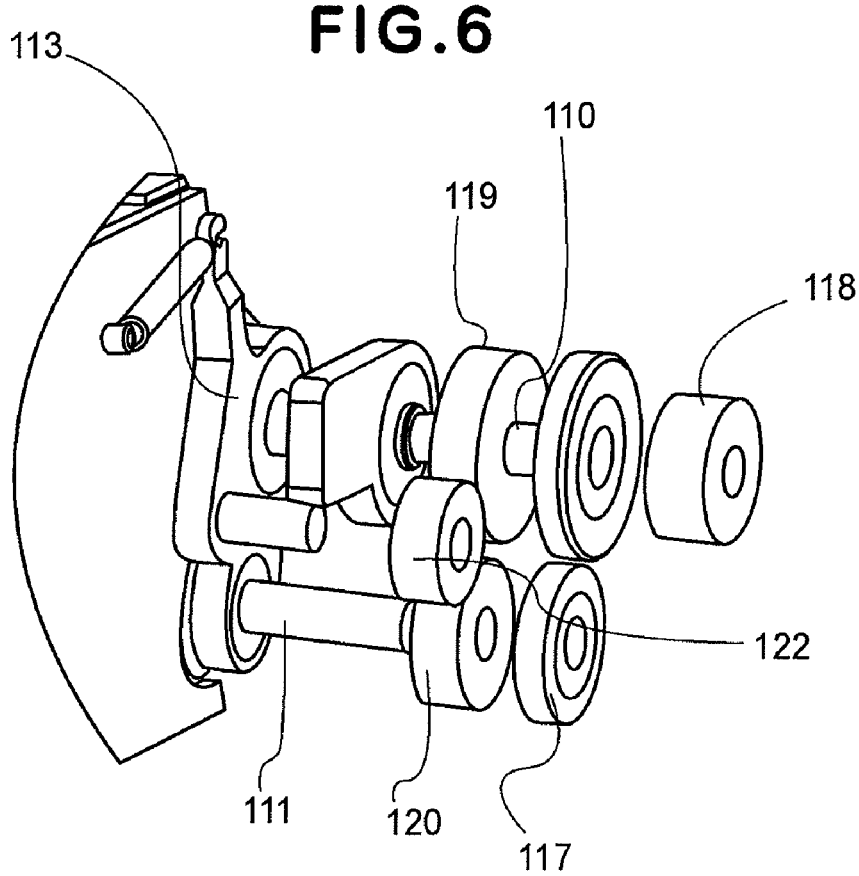
FIG.7 PRIOR ART
FIG. 7 is a perspective view of a part of the developing apparatus in accordance with the prior art.
Figure 8:
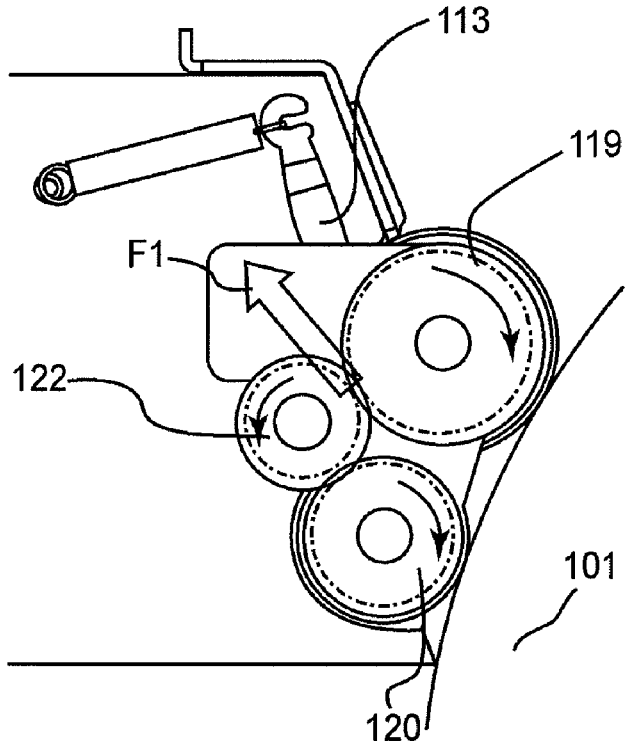
FIG.8 PRIOR ART
FIG. 8 is a schematic drawing of the part of the developing apparatus shown in FIG. 7, which is being driven.

FIG. 6 simply shows the relationship among the forces which are generated as the second development sleeve 11 is rotated by the rotation of the first development sleeve 10. For simplification, the pulleys 23 and 24 are represented by the circle designated by a referential code Φ28 and the circle designated by a referential code Φ20, respectively. If the amount of torque necessary to rotate the second development sleeve 11 is 1 kgf·cm, the force which the second development sleeve 11 receives from the timing belt 25 is 1 kgf·cm.

This force separates into two components, that is, the component directed toward the axial line of the first development sleeve 10 and the component parallel to the rotational direction of the first development sleeve 10. The component directed toward the axial line of the first development sleeve 10 reduces the component parallel to the rotational direction of the first development sleeve 10. Thus, the force which acts in the direction to rotationally move the second development sleeve 11 about the axial line of the first development sleeve 10 is only 0.45 kgf.

Figure 9:
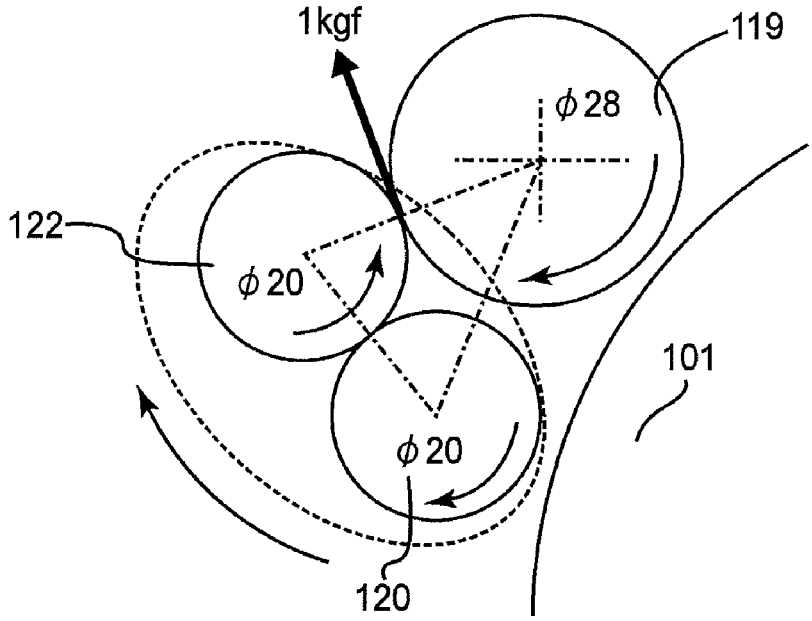
FIG.9 PRIOR ART
FIG. 9 is a schematic drawing for describing the forces which are generated as the developing apparatus structured as shown in FIG. 8 is driven.
Figure 10:
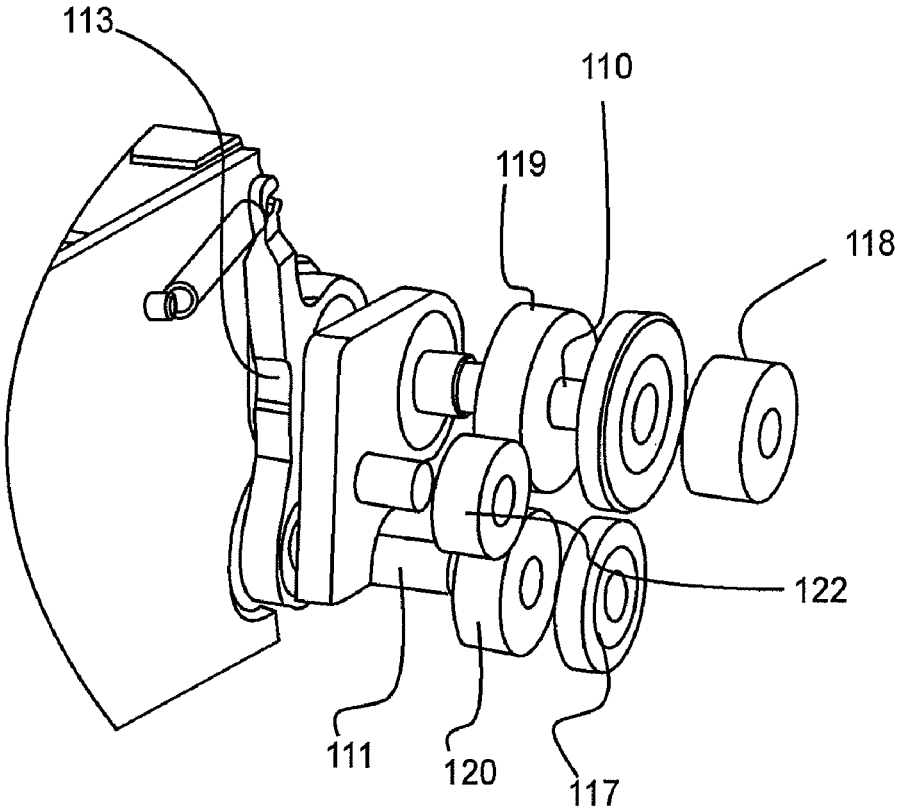
FIG.10 PRIOR ART
FIG. 10 is a perspective view of a part of another developing apparatus in accordance with a prior art.
Figure 11:
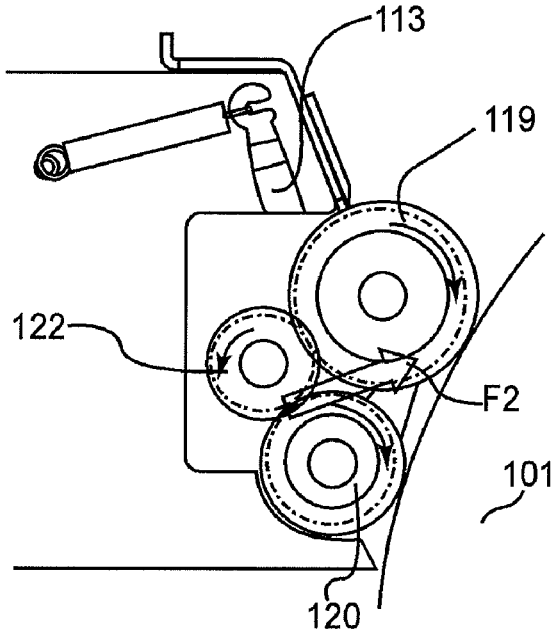
FIG.11 PRIOR ART
FIG. 11 is a schematic drawing of the part of the developing apparatus shown in FIG. 10, which is being driven.
Figure 12:
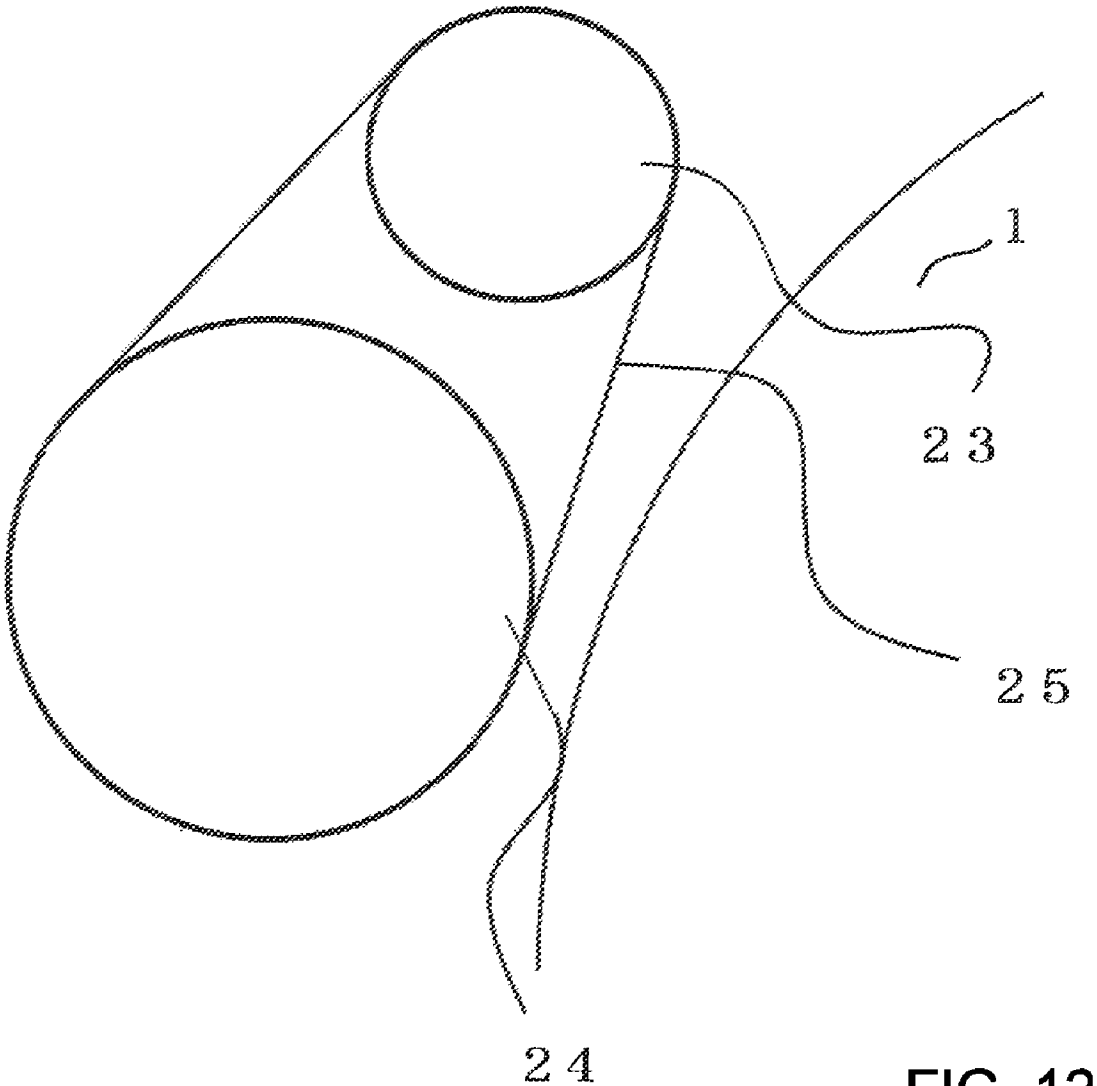
FIG. 12 is a schematic drawing of an alternative embodiment for the developing apparatus shown in FIG. 5.

Further, the timing belt 25 is disposed so that, of the force which the second development sleeve 11 receives from the timing belt 25, the component perpendicular to the direction in which the second development sleeve 11 is allowed to move in the oscillatory manner, that is, the component perpendicular to the direction in which the pivotally movable connective holder 13 is pivotally movable, becomes greater than the component parallel to the direction in which the second development sleeve 11 is allowed to move in the oscillatory manner. In other words, the timing belt 25 is disposed so that the amount of the force generated in the direction to pivot the pivotally movable connective holder 13 as the motor 30 is driven, becomes smaller than the force transmitted to the first development sleeve 10 from the motor 30 as the motor 30 is driven. For comparison, it is assumed that the force from the motor 30 is transmitted through gears as shown in FIG. 9. In this case, the amount of the force by which pivotally movable connective holder 13 is pivotally moved about the axial line of the first development sleeve 10 is 1 kgf. That is, the 100% of the force which drives the first development sleeve 10 functions as the force which pivotally moves the pivotally movable connective holder 13. Incidentally, the pulley 23 may be made smaller in diameter than the pulley 24, as shown in FIG. 12. This arrangement makes it possible to make the above-mentioned component force which is perpendicular to the direction in which the second development sleeve 11 is rotationally moved in an oscillatory manner (direction in which pivotally movable connective holder 13 is pivotally moved), even greater than the component force which is parallel to the direction in which the second development sleeve 11 is allowed to rotationally move in an oscillatory manner (component force which presses second development sleeve 11 toward axial line of first development sleeve 10). Therefore, it can further reduce the force which is generated in the direction to pivotally move the pivotally movable connective holder 13 when the first development sleeve 10 is driven.

As described above, in this embodiment, the timing belt 25 is employed to transmit the second development sleeve 11 driving force from the first development sleeve 10 to the second development sleeve 11 as described above. Therefore, the force which is generated in the direction to rotationally move the second development sleeve 11 away from the photosensitive drum 1 as the first development sleeve 10 of the developing apparatus 21 in this embodiment is driven is smaller by 55% than that generated as the first development sleeve of a developing apparatus in accordance with the prior art is driven.

Further, the ratio of reduction is affected by the change in the reduction ratio in the driving force transmission. For example, increasing the reduction ratio in the transmission of the driving force from the first development sleeve 10 to the second development sleeve 11 increases the ratio by which the force which acts in the direction to rotationally move the second development sleeve 11 away from the photosensitive drum 1 is reduced. Reduction in the fluctuation of the pressure to which the second development sleeve 11 is subjected, makes it possible to stabilize the amount of the force to which the second development sleeve 11 is subjected, making it therefore possible to stabilize the SD gap.

As described above, in this embodiment, the timing belt 25 is employed to transmit driving force from the first development sleeve 10 to the second development sleeve 11. Thus, the force to which the second development sleeve 11 is subjected as driving force is transmitted to the second development sleeve 10 from the first development sleeve 10 is separated into the component which acts in the direction to rotationally move the second development sleeve 11 away from the photosensitive drum 101, and the component which acts in the direction to press the second development sleeve 11 toward the axial line of the first development sleeve 10. Therefore, the amount by which driving force is transmitted to the second development sleeve 11 remains stable. Therefore, the force by which the first and second development sleeves 10 and 11 are kept pressed upon the peripheral surface of the photosensitive drum 1 remain stable, and therefore, the SD gaps remain stable.

Further, in the embodiment described above, the first spring 26 is used as the member for keeping the developing apparatus frame 3 pressured toward the photosensitive drum 1, and the second spring 14 was used for keeping the second development sleeve 11 pressured toward the photosensitive drum 1. However, this setup is not intended to limit the present invention in terms of the choice of the member for keeping the developing apparatus frame 3 and second development sleeve 11 under pressure. That is, the present invention is also applicable to a developing apparatus which employs an elastic member other than the one used in the embodiment described above, for example, a plate spring (leaf spring), a torsional spring, etc.

Also in this embodiment, ball bearings were used as the member for supporting the first and second development sleeves 10 and 11. However, this embodiment is not intended to limit the present invention in terms of the development sleeve supporting member. For example, the present invention is also applicable to a developing apparatus which employs a plain bearing formed of a resin, a substance made up of sintered metal, or the like.

Also in this embodiment, the spacer rollers 16 and 17 are placed directly in contact with the peripheral surface of the photosensitive drum 1. However, the present invention is also applicable to a developing apparatus, the spacer rollers of which are placed in contact with a spacer roller seat or the like, instead of the peripheral surface of the photosensitive drum.

Further, the timing belt 25 was used as the means for transmitting driving force from the first development sleeve 10 to the second development sleeve 11. However, this embodiment is not intended to limit the present invention in terms of the means for transmitting driving force from the first development sleeve 10 to the second development sleeve 11. That is, the present invention is also applicable to a developing apparatus which employs a chain or the like instead of the timing belt 25.

According to the present invention, a belt is used to transmit driving force from the first developer bearing member to the second developer bearing member. Therefore, the force which affects the oscillatory movement of the second development sleeve is separated into the component which is parallel to the plane coinciding with the axial line of the first development bearing member and the axial line of the second developer bearing member, and the component which is parallel to the direction of the oscillatory movement of the second development sleeve. Therefore, driving force is reliably transmitted to the second development sleeve.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 253127/2007 filed Sep. 28, 2007 which is hereby incorporated by reference.

What is claimed is:

1. A developing apparatus for developing a latent image formed on an image bearing member with a developer, said apparatus comprising:

a first developer carrying member for feeding the developer to a first developing zone opposed to said image bearing member;

a second developer carrying member for feeding the developer to a second developing zone opposed to said image bearing member;

a supporting member for supporting said second developer carrying member swingably about said first developer carrying member;

a driving device for applying a driving force to said first developer carrying member; and a driving belt for transmitting the driving force applied to said first developer carrying member to said second developer carrying member;

a first supporting portion provided on a rotation shaft of said first developer carrying member and supporting said driving belt; and a second supporting portion provided on a rotation shaft of said second developer carrying member and supporting said driving belt, wherein said second supporting portion has a diameter which is larger than a diameter of said first supporting portion.

2. An apparatus according to claim 1, wherein said first developer carrying member is disposed upstream of said second developer carrying member with respect to a peripheral moving direction of said image bearing member.

3. An apparatus according to claim 1, wherein said first developer carrying member and said second developer carrying member rotate in the same rotational direction.

4. An apparatus according to claim 1, wherein said first developer carrying member rotates in a direction opposite that of said image bearing member.

5. An apparatus according to claim 1, further comprising:

a first abutment member, provided at one end with respect to a direction of a rotational axis of said first developer carrying member, for abutting an abutting portion provided at one longitudinal end of said image bearing member to provide a constant gap between said image bearing member and said first developer carrying member;

a second abutment member, provided at the other end with respect to the direction of the rotational axis of said first developer carrying member, for abutting an abutting portion provided at the other longitudinal end of said image bearing member to provide the constant gap between said image bearing member and said first developer carrying member;

a third abutment member, provided at one end with respect to a direction of a rotational axis of said second developer carrying member, for abutting an abutting portion provided at said one longitudinal end of said image bearing member to provide a constant gap between said image bearing member and said second developer carrying member; and a fourth abutment member, provided at the other end with respect to the direction of the rotational axis of said second developer carrying member, for abutting an abutting portion provided at the other longitudinal end of said image bearing member to provide the constant gap between said image bearing member and said second developer carrying member.

6. An apparatus according to claim 1, wherein in a downstreammost position of said second developer carrying member with respect to a rotational moving direction thereof in a region of said second developer carrying member in which said driving belt is supported, a component of a tension in said driving belt in a direction perpendicular to a direction toward a rotation axis of said first developer carrying member is smaller than a component thereof in the direction toward the rotation axis.

7. An apparatus according to claim 1, wherein said driving belt is provided such that force, in a swing direction, of said supporting member produced by driving said driving device is smaller than the driving force for driving said first developer carrying member.

8. An apparatus according to claim 7, wherein a force applied to said second developer carrying member has a force component toward a rotational axis of said first developer carrying member, which is smaller than a force component in a rotational direction of said first developer carrying member.

9. An apparatus according to claim 1, wherein said driving belt is provided such that force received by said second developer carrying member from said driving belt includes a force component in a direction toward a rotational axis of said first developer carrying member in a drive operation of said driving device.

* * * * *